US008596981B2

(12) United States Patent
Hoyland et al.

(10) Patent No.: US 8,596,981 B2
(45) Date of Patent: Dec. 3, 2013

(54) ANNULUS FILLER FOR A GAS TURBINE ENGINE

(75) Inventors: Mathew Ashley Charles Hoyland, Chesterfield (GB); Dale Edward Evans, Derby (GB)

(73) Assignee: Rolls-Royce PLC (GB)

( * ) Notice: Subject to any disclaimer, the term of this patent is extended or adjusted under 35 U.S.C. 154(b) by 806 days.

(21) Appl. No.: 12/817,605

(22) Filed: Jun. 17, 2010

(65) Prior Publication Data

US 2010/0322772 A1 Dec. 23, 2010

(30) Foreign Application Priority Data

Jun. 23, 2009 (GB) ..... 0910752.5

(51) Int. Cl.
*F01D 5/22* (2006.01)
*F01D 11/00* (2006.01)

(52) U.S. Cl.
USPC ..... 416/193 R

(58) Field of Classification Search
USPC ..... 416/190, 193 R, 193 A, 195, 194, 196 R, 416/219 R, 220 R
See application file for complete search history.

(56) References Cited

U.S. PATENT DOCUMENTS

| | | | | |
|---|---|---|---|---|
| 2,935,296 | A | 5/1960 | Hockert et al. | |
| 3,245,657 | A | 4/1966 | Cooper, Jr. et al. | |
| 3,712,757 | A * | 1/1973 | Goodwin | 416/245 R |
| 3,734,646 | A | 5/1973 | Perkins | |
| 4,875,830 | A | 10/1989 | Trousdell et al. | |
| 5,131,814 | A | 7/1992 | Przytulski et al. | |
| 5,259,728 | A | 11/1993 | Szpunar et al. | |
| 5,624,233 | A | 4/1997 | King et al. | |
| 6,253,632 | B1 | 7/2001 | Poulek | |
| 6,634,863 | B1 | 10/2003 | Forrester et al. | |
| 6,726,452 | B2 | 4/2004 | Strassberger et al. | |
| 6,929,453 | B2 | 8/2005 | Kite et al. | |
| 2005/0129522 | A1 | 6/2005 | Kite et al. | |
| 2007/0059163 | A1 | 3/2007 | Tiemann | |
| 2008/0018056 | A1 * | 1/2008 | Evans | 277/590 |

FOREIGN PATENT DOCUMENTS

| | | | |
|---|---|---|---|
| DE | 3121136 | A1 | 12/1982 |
| DE | 19548593 | A1 | 7/1997 |
| DE | 19931765 | A1 | 1/2001 |
| EP | 1881160 | A2 | 1/2008 |
| EP | 2090749 | A2 | 8/2009 |
| EP | 2108786 | A2 | 10/2009 |
| GB | 1331209 | | 9/1973 |
| GB | 2171151 | A | 8/1986 |
| SU | 480882 | A1 | 8/1975 |
| WO | 02076665 | A1 | 10/2002 |
| WO | 2005049420 | A1 | 6/2005 |

* cited by examiner

*Primary Examiner* — Nathaniel Wiehe
*Assistant Examiner* — Jeffrey A Brownson
(74) *Attorney, Agent, or Firm* — McCormick, Paulding & Huber LLP

(57) ABSTRACT

An annulus filler for mounting to a rotor disc of a gas turbine engine is provided to bridge the gap between adjacent blades. A first part is connectable to the rotor disc between adjacent blades. There is a separate second part that engages with the first part after connecting the rotor blades to the rotor disc. When installed, the filler is spaced from each blade by a respective clearance gap (G), and an operational configuration in which it contacts each of said blades. Engagement of the second part with the first part is effective to urge the first part from said installation configuration to said operational configuration and thus into blade contact. The first part may have a mounting region for connection to the rotor disc and allow, in said first step of said procedure, the mounting region to remain visible from a radially outer viewpoint.

15 Claims, 3 Drawing Sheets

ANNULUS FILLER FOR A GAS TURBINE ENGINE

CROSS REFERENCE TO RELATED APPLICATION

This application is entitled to the benefit of British Patent Application No. GB 0910752.5, filed on Jun. 23, 2009.

FIELD OF THE INVENTION

The present invention relates to annulus fillers for bridging gaps between adjacent blades of a gas turbine engine stage.

BACKGROUND OF THE INVENTION

Conventionally, each compressor rotor stage of a gas turbine engine comprises a plurality of radially extending blades mounted on a rotor disc. The blades are mounted on the disc by inserting a root portion of the blade in a complementary retention groove in the outer face of the disc periphery. To ensure a smooth radially inner surface for air to flow over as it passes through the stage, annulus fillers are used to bridge the spaces between adjacent blades. Typically, seals between the annulus fillers and the adjacent fan blades are also provided by resilient strips bonded to the annulus fillers adjacent the fan blades.

Annulus fillers of this type are commonly used in the fan stage of gas turbine engines. The fillers may be manufactured from relatively lightweight materials and, in the event of damage, may be replaced independently of the blades.

It is known to provide annulus fillers with features for removably attaching them to the rotor disc. For example, it has been proposed to provide annulus fillers with axially spaced hook members, the hook members sliding into engagement with respective parts of the rotor disc. FIG. 1 shows an example of such an annulus filler viewed from the side, and FIG. 2 shows the annulus filler fitted to the rotor disc as viewed in transverse cross-section.

In use, the upper surface or lid 2 of the annulus filler 1 bridges the gap between two adjacent fan blades 3 (one of which is shown in outline in FIG. 2) and defines the inner wall of the flow annulus of a fan stage. The annulus filler 1 is mounted on a fan disc 4 by two hook members 5, 6 respectively towards the forward and rearward ends of the annulus filler 1. The hook members are configured to engage with outwardly directed hooks provided on the fan disc 4. The annulus filler is also attached to a support ring 7 by a retention flange 8 provided at the forward end of the annulus filler. Along its rear edge, the annulus filler is provided with a rear lip 9 which is configured to fit under a rear fan seal 10 located axially behind the rotor disc 4 to limit deflection under running conditions. Similarly, the front edge of the annulus filler defines a front lip 11, which is configured to fit under a spinner fairing 12 located axially ahead of the annulus filler. The two opposed side faces 13, 14 of the annulus filler are provided with respective seal strips (not shown) and confront the aerofoil surfaces of the adjacent fan blades 3 in a sealing manner.

As illustrated in more detail in FIG. 3, the retention flange 8 carries a forwardly extending spigot or pin 15. The spigot or pin 15 is arranged for engagement within a corresponding aperture or recess provided in the support ring 7. At a position circumferentially adjacent the spigot or pin 15, the retention flange is also provided with a mounting aperture 16 which is arranged for co-alignment with a corresponding mounting aperture (not shown) provided through the support ring 7. The co-aligned mounting apertures are sized to receive a mounting bolt. Thus, it will be appreciated that the retention flange 8 is pinned and bolted to the front support ring 7.

FIG. 4 illustrates the typical form of the rear hook member 6, as viewed from behind. As can be seen, the hook member defines an arcuate channel 17. The channel 17 is curved in such a manner as to be centred on the rotational axis of the engine (not shown), and cooperates with a correspondingly arcuate hook on the rotor disc 4. The front hook member 5 has a similar arcuate configuration.

A problem which has been experienced with prior art annulus fillers of the general type described above is that of reliable installation during engine assembly. As will be appreciated by those of skill in the art, the annulus filler must be fitted after the radially extending fan blades have been attached to the rotor disc. This means when the fitter then comes to install the annulus fillers between adjacent blades, his or her line of sight is obstructed by the presence of the fan blades. Also, the unitary construction of the annulus filler exacerbates this problem, because the filler lid 2 also obstructs the fitter's view when attempting to engage the hook members 5, 6 with the rotor disc 4. Misassembly of the rear hook member 6 has been found to be a particular problem in this regard and has been attributed to the release of annulus fillers in operation.

Annulus fillers of the prior-art type described above are self-loading in the sense that, as a rotating component, the majority of forces on the filler are generated by its own mass. This can be modelled as an approximately radial force acting through the centre of gravity of the annulus filler. However, in the event of a bird-strike, or a fan blade otherwise becoming detached from the rotor (i.e. a so-called "fan-blade-off" event), the blades can apply tangential pushing forces to the adjacent annulus fillers thereby tending to pinch the annulus fillers between the blades as the blades pivot tangentially in their retention grooves. This can cause the annulus fillers to become detached from the rotor. In this regard, it is to be noted that a bird-strike or fan-blade-off event creates substantial imbalance in the rotor, and so even the remaining fan blades can deflect considerably due to their tips impinging on the outer casing surrounding the rotor. Thus it is not unknown to lose annulus fillers from circumferential positions well away from the primary release blade.

It has been found that the above-described configuration of annulus filler can increase the likelihood of the filler failing under the action of the tangential forces applied to it by the adjacent fan blades. Due to the curved nature of the interface between the hook members 5, 6 on the annulus filler and the cooperating hooks formed on the rotor disc 4, the natural tendency of an annulus filler pushed from the side by an adjacent fan blade is to move rotationally relative to the disc, about the engine axis. However, because the front end of the filler is securely fixed by being pinned and bolted to the support ring, the front region of the filler is not permitted to deflect in this manner. The result is that the annulus filler becomes twisted along its length, which can lead to the filler fracturing between the retention flange 8 and the front hook member 5. As will be appreciated, failure of annulus fillers in this manner is problematic as it increases the amount of shrapnel moving around inside engine during a bird-strike or fan-blade-off event, which can have serious consequences for the integrity of the engine.

SUMMARY OF THE INVENTION

It is therefore an object of the present invention to provide an improved annulus filler.

According to a first aspect of the invention there is provided a method of mounting an annulus filler to a rotor disc of a gas turbine engine, the annulus filler bridging the gap between two adjacent blades attached to the rotor disc, the annulus filler having:

a first part which is connectable to the rotor disc between the positions of said adjacent blades, and a separate second part configured for engagement with the first part, characterised in that the method comprises the steps of installing the first part on the rotor disc in an installation configuration in which it is spaced from each said blade by a respective clearance gap, and subsequently engaging the second part with the first part to urge the first part from the installation configuration to an operational configuration in which it substantially contacts each of said blades.

The first part may be installed on the rotor disc in the installation configuration prior to connection of said blades to said rotor disc.

The step of installing the first part to the disc may include securing the first part on the rotor disc using a mechanical fastener. The mechanical fastener may be releasable and include a threaded shank and corresponding receptacle, rivet or other appropriate device.

The step of installing the first part to the disc may include the step of inspecting the mechanical fastener after securing the first part on the rotor disc and prior to the engagement of the second part with the first part.

The first part may have, in transverse cross-section, a pair of spaced-apart and generally radially oriented arms, wherein on engagement of said second part with said first part the radially outer regions of said arms are urged further apart from one another.

The second part may be slid into engagement with said first part in a direction perpendicular to the transverse cross-section.

The second part may be removably engaged with axial grooves provided in each arm with each groove receiving a respective edge of said second part.

The first part may be provided with a pair of seals that contact and substantially seal against respective blades when in said operational configuration.

According to a second aspect of the present invention, there is provided an annulus filler for mounting to a rotor disc of a gas turbine engine and for bridging the gap between two adjacent blades attached to the rotor disc, the annulus filler having:

a first part which is connectable to the rotor disc between the positions of said adjacent blades, and a separate second part configured for engagement with the first part, characterised in that said first part has, in transverse cross-section, a pair of spaced-apart and generally radially orientated arms resiliently biased towards an installation configuration in which the first part is spaced from each said blade by a respective clearance gap (G), and an operational configuration in which it substantially contacts each of said blades, wherein engagement of the second part with the first part is effective to urge the first part from said installation configuration to said operational configuration and thus towards contact with said blades.

The first and second parts may be configured to allow a procedure for mounting the annulus filler to the rotor disc, the procedure having a first step in which the first part is connected to the rotor disc without the second part and whilst in said installation configuration, and a subsequent second step in which the second part is engaged with the first part to urge the first part from said installation configuration to said operational configuration and thus towards contact with said blades.

Said first step may occur prior to connection of said blades to said rotor disc, and said second step may occur after connection of said blades to said rotor disc.

The first part may have at least one mounting region for connection to the rotor disc and may be configured to allow the or each mounting region to remain substantially visible from a radially outer viewpoint after the first part is mounted to the rotor disc.

Conveniently, said first and second parts may be configured to allow the engaging regions of said first and second parts to remain substantially visible from a radially outer viewpoint (37) during said second step.

The second part may be configured for engagement with said first part in a sliding manner, in a substantially axial direction.

The first part may be configured such that when in said installation configuration, the arms lie substantially parallel to one another in transverse cross-section.

Each arm may be provided with an axial groove configured to slideably receive a respective edge of said second part.

Said first part may be provided with a pair of seals to contact and substantially seal against respective blades when in said operational configuration. Each said seal may be provided in the radially outer region of a respective said arm.

The first part may be formed from a first material and the second part formed from a different second material. More particularly, the first part may be formed from a metal material. The second part may be formed from plastics material.

At least one of said first and second parts may define part of an airflow surface for air drawn through the engine.

Said first and second parts may define respective regions of an airflow surface for air drawn through the engine, the first and second parts having respective outer surfaces which lie substantially flush when the parts are engaged with one another.

A stage for a gas turbine engine may have: a rotor disc; a plurality of circumferentially spaced apart blades attached to the rotor disc; and a plurality of annulus fillers in accordance with a second aspect of the invention. Optional features of the first or second aspect may apply, as appropriate.

A stage for a gas turbine engine may have: a rotor disc; a plurality of circumferentially spaced apart blades attached to the rotor disc; and a plurality of annulus fillers mounted to the rotor disc in accordance with the first aspect of the invention. Optional features of the first or second aspect may apply, as appropriate.

DETAILED DESCRIPTION OF THE PREFERRED EMBODIMENTS

Figure 1:
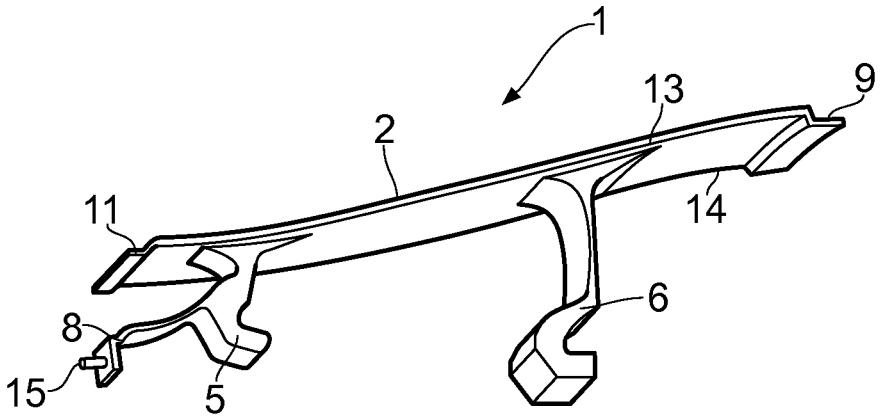
FIG. 1 (Prior Art)
FIG. 1 shows a prior-art annulus filler, viewed from the side.
Figure 2:
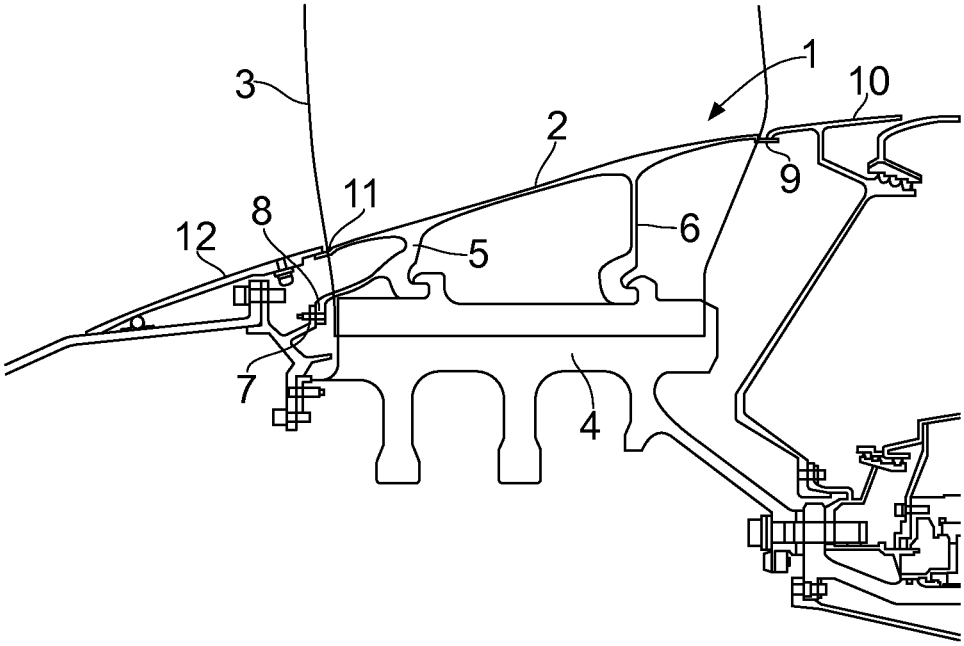
FIG. 2 (Prior Art)
FIG. 2 shows the annulus filler of FIG. 1, installed in a gas turbine engine.
Figure 3:
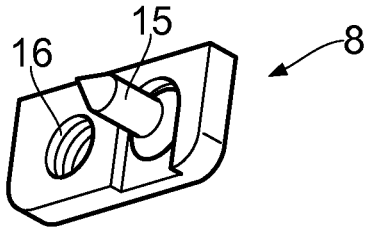
FIG. 3 (Prior Art)
FIG. 3 is an enlarged view of part of the annulus filler shown in FIGS. 1 and 2, as viewed from the front.
Figure 4:
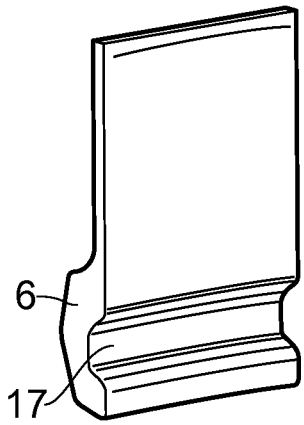
FIG. 4 (Prior Art)
FIG. 4 is an enlarged view of another part of the annulus filler shown in FIGS. 1 and 2, as viewed from the rear.
Figure 5:
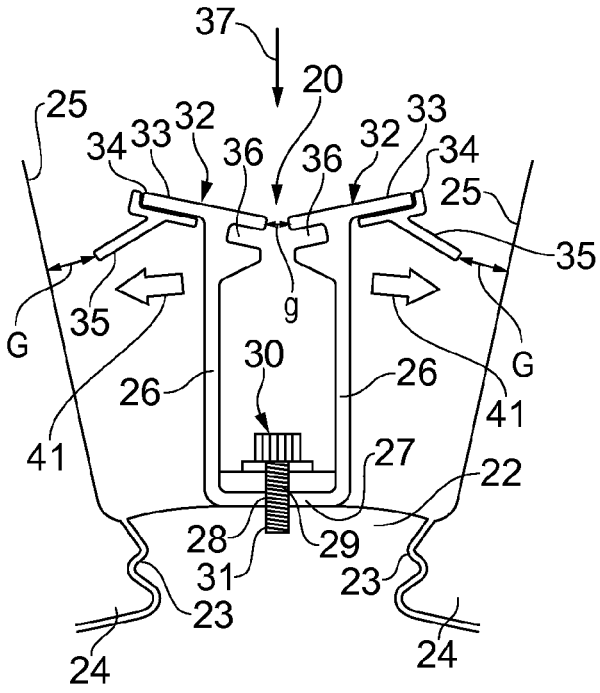
FIG. 5 is a transverse cross-sectional view showing a first part of an annulus filler in accordance with the present invention connected to a rotor disc between the positions of a pair of adjacent blades, and in a first configuration.

Referring now in more detail to FIG. 5, there is shown a first part 20 of a two-part annulus filler 21. A portion of the radially outer region of a compressor fan rotor disc 22 is also shown. In a generally conventional manner, the radially outer surface of the rotor disc 22 is provided with a plurality of circumferentially spaced-apart retention grooves 23 (parts of two such grooves being illustrated in FIG. 5) for receiving and retaining the root portions 24 of respective fan blades 25. The retention grooves 23 may be straight or curved and extend generally in the axial direction of the engine. In the particular arrangement illustrated in FIG. 5, the retention grooves 23 have a generally "fir-tree"-" shaped cross-sectional profile and the root portions 24 of the blades have a complementary fir-tree profile in order to provide an accurate and strong connection between each blade and the rotor disc 22. However, it is to be appreciated that in alternative embodiments, particularly those intended for use in the fan of a gas turbine engine, the retention grooves 23 and the root portions 24 of the blades could have complementary dovetail profiles instead.

The first part 20 of the annulus filler takes the form of a generally elongate body extending in the axial direction of the engine. FIG. 5 illustrates the body part 20 in transverse cross-section and shows it in an initial installation configuration, which will be described in more detail below. The body part is resiliently deformable and is configured such that in its natural relaxed condition, it adopts the installation configuration illustrated in FIG. 5. The body part is preferably formed from metal such as aluminium, titanium or magnesium alloys and may be extruded or metal injection moulded.

In transverse cross-section (as shown in FIG. 5), the body part 20 has a pair of spaced-apart arms 26 which are arranged so as to extend generally radially outwardly from a mounting region 27. The mounting region 27 forms an integral part of the body 20 and serves to interconnect the two arms 26 at their radially innermost ends. The mounting region 27 has a curved profile and is thus configured for intimate engagement against the outer surface of the rotor disc 22.

FIG. 5 shows the body part 20 connected to the rotor disc 22. This connection can be effected in a number of alternative ways. In the particular arrangement illustrated, the mounting region 27 of the first part 20 is provided with a number of mounting apertures 28 at spaced-apart positions along its axial length. Each mounting aperture 28 is configured to receive therethrough the threaded shank 29 of a mounting bolt 30 for threaded engagement within an aligned mounting recess 31 provided in the outer region of the rotor disc 22. Thus, it will be appreciated that the particular mounting arrangement illustrated in FIG. 5 uses generally radially oriented mounting bolts 30. However, as indicated above, alternative mounting arrangements could also be used which could, for example, use axially orientated mounting bolts or the like. Other mounting arrangements are also possible.

Each arm 26 supports an enlarged formation 32 at its radially outermost end, each formation extending both inwardly into the space defined between the two arms 26 and outwardly so as to extend generally towards the respective adjacent rotor blade 25. More particularly, each formation 32 presents a generally radially-outwardly directed surface 33 and defines an axially extending side edge 34. In the arrangement illustrated in FIG. 5, the body part 20 is provided with a pair of sealing members 35 each of which is mounted along a respective side edge 34.

The region of each formation 32 extending generally inwardly into the space defined between the two supporting arms 26 is configured so as to define a generally axially extending groove 36. The two grooves 36 are arranged so as to oppose one another and are each open in a direction facing the opposite groove.

As indicated above, FIG. 5 shows the resilient body part 20 in a relaxed condition in which it adopts an initial installation configuration. In this configuration, it is to be noted that each outwardly extending sealing member 35 is spaced from the adjacent rotor blade 25 by a clearance gap G, whilst the inwardly directed regions of the formations 32 defining the opposed grooves 36 are spaced from one another by a clearance gap g which is of a size sufficient to permit the passage therethrough of a tool for use in installing and tightening the mounting bolts 30. This configuration of the body part 20 thus permits the rotor blades 25 to be easily mounted to the rotor disc 22 after the body part 20 has been mounted to the rotor disc 22. The clearance gaps G between each side of the body part 20 and the adjacent rotor blades 25 allows the rotor blades 25 to be properly located and offered up to the rotor disc 22 without hindrance by body parts 20, the gaps allowing movement of the blades from side to side as might be necessary as they are manipulated into engagement with their respective retention grooves 23. However, it is to be noted that whilst it is envisaged that the body parts 20 of respective annulus fillers will usually be mounted to the rotor disc prior to the rotor blades 25, the configuration of the body part would also permit an alternative assembly order in which the rotor blades 25 are mounted to the rotor disc first, followed by the body parts.

Additionally, the clearance gap g between the inwardly directed regions of the formations 32 allows a person fitting the annulus filler to the rotor disc 22 to view the mounting region 27 in a generally radial direction denoted by arrow 37, through the gap, thereby allowing accurate alignment of the mounting apertures 28 with respective mounting recesses 31 formed in the outer periphery of the rotor disc 22. The clearance gap g also permits the passage therethrough of a tool for installation and tightening of the mounting bolts 30, whilst simultaneously allowing clear sight of the bolts. As will be appreciated, it will be generally easier to mount the body part 20 to the rotor disc in this manner in the absence of the rotor blades 25 as the fitter will be afforded a clearer view and easier tool access.

Figure 6:
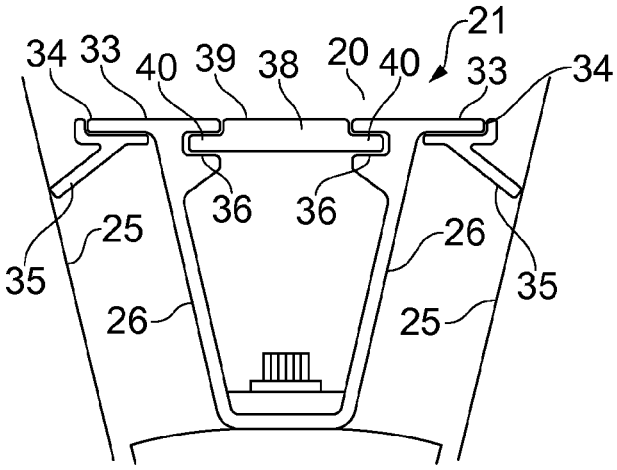
FIG. 6 is a cross-sectional view similar to that of FIG. 5, showing the first part in combination with a second part of the annulus filler, and with the first part in a second configuration in which it contacts the adjacent blades.

Turning now to consider FIG. 6, the above-described body part 20 of the annulus filler 21 is shown in combination with a separate second part 38. The second part 38 takes the form of an elongate slider which is configured for engagement with the body part 20 in a manner effective to urge the body part 20 against the bias of its inherent resiliency, so as to move from the initial installation configuration illustrated in FIG. 5 towards an alternate, operational configuration as illustrated in FIG. 6.

The second part, or slider 38, has a radial cross-sectional profile, which presents a generally smooth radially outer surface 39. The slider 38 is provided with a pair of oppositely directed flanges 40 running along respective side edges. As thus illustrated in FIG. 6, the oppositely directed side flanges 40 of the slider 38 are thus configured for sliding engagement within respective grooves 36 formed in the body part 20. After the rotor blades 25 have been connected to the rotor disc, the slider 38 may thus be slidingly engaged with the body part 20 in a substantially axial direction relative to the axis of the engine (i.e. into the page as viewing FIG. 6). In this regard, it is to be noted that a person fitting the annulus filler to the rotor disc 22 is afforded a clear view of the slider 38 in the radial viewing direction 37 as it is engaged with the body part 20, thereby ensuring reliable connection of the two components.

Sliding engagement of the slider 38 with the body part 20 is effective to drive the support arms 26 outwardly, as indicated by arrows 41 in FIG. 5, such that they move from being substantially parallel to one another as illustrated in FIG. 5 to being divergent as illustrated in FIG. 6. It will thus be appreciated that in the configuration illustrated in FIG. 6, the transverse cross-sectional profile of the body part 20 is generally V-shaped, and in this configuration the clearance gaps G between the side edges of the two sealing members 35 and the adjacent rotor blades 25 have been closed such that the sealing members 35 are brought into close and intimate sealing contact with the surfaces of the rotor blades 25.

When the slider 38 is fully engaged with the body 20 such that the body 20 adopts the operational configuration illustrated in FIG. 6, the radially outer surfaces 33 of the body part 20 lie substantially flush with the radially outer surface 39 of the slider 38. The flush-lying surfaces 33, 39 thus cooperate to define respective regions of an airflow surface for air drawn through the engine, the airflow surface extending generally between the adjacent rotor blades 25.

It is envisaged that the slider 38 could either be made from suitable metal material such as aluminium, titanium or magnesium alloys. Alternatively, however, the slider 38 could be formed from plastic material. For example, material for the slider may be a carbon- or glass-fibre reinforced thermoplastic, such as Torlon™ 5030/7030 (polyamide-imide) from Solvay Advanced Polymers. Such a slider could be formed by injection or compression moulding. Alternatively, the slider could be formed from fibre reinforced epoxy, for example by compression moulding. Injection moulding generally requires short reinforcing fibres. Compression moulding could use longer fibres.

As will thus be appreciated, the two-part annulus filler 21 of the present invention offers significant advantages over prior art annulus filler designs in that it permits an installation process in which the fitter has substantially unobstructed sight of the mounting region 27 of the annulus filler as it is offered up to and connected to the rotor disc, and substantially unobstructed sight of the flanges 40 of the slider 38 and the cooperating grooves 36 formed in the body part as the slider is offered up to and engaged with the body part, even in the event that the adjacent rotor blades have already been assembled. This significantly reduces the potential for mal-assembly of the annulus filler, which in turn reduces the likelihood of the annulus filler becoming detached from the rotor in service.

Additionally, the annulus filler design of the present invention also provides distinct advantages in the event of a fan-blade-off event. The generally V-shaped transverse cross-sectional profile of the body part 20 when in its operational configuration, and its deformable nature, provides a degree of flexibility that allows the annulus filler to rotate relative to the axis of the engine when pushed from the side by a deflecting rotor blade. Should the filler nevertheless fail due to the forces exerted on it by an adjacent deflecting blade, it is likely that only the slider 38 (and perhaps also the radially outer region of the arms 26 supporting the formations 32) will fail, leaving intact the radially inner region of the arms, which will thus remain securely connected to the rotor disc. As only the slider 38 (and perhaps also a portion of the body part 20) is thus likely to be released under such circumstances, the mass and therefore energy of the resulting debris will thus be reduced in comparison to the sort of failure experienced with prior art annulus fillers. This reduces the amount of shrapnel moving around in the fan-case of the engine, thereby reducing the risk of high-energy debris causing further damage to the engine. Also, by making the slider 38 from plastic or composite materials proposed above rather than metal, the weight of any such shrapnel will be significantly reduced, thereby reducing the likelihood of the shrapnel causing serious damage to the engine.

Figure 7:
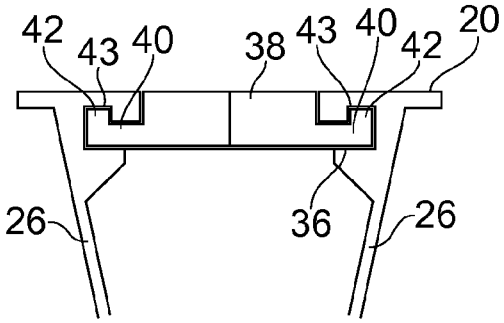
FIG. 7 is a transverse cross-sectional view taken through a region of an annulus filler in accordance with another embodiment of the present invention.

Turning now to consider FIG. 7, there is illustrated an alternative embodiment of the present invention in which the side flanges 40 of the slider 38, and the cooperating axial grooves 36 of the body part 20 have a modified cross-sectional profile. In this arrangement, it will be seen that the flanges 40 of the slider 38 are each provided with a small radially outwardly directed lip 42. The cooperating grooves 36 in the body part are configured so as to have a corresponding re-entrant region 43 sized and shaped to receive a respective side lip 42 of the slider 38. This modified form of engagement between the slider 38 and the body part 20 serves to further resist possible release of the slider 38 due to circumferential deflection of the arms 26 of the body part 20 during operation of the engine. Engagement of the side lips 42 within the re-entrant regions 43 of the grooves 36 is thus effective to prevent disengagement of the side flanges 40 of the slider 38 from the grooves 36 during significant circumferential deflection of the arms 26.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A method of mounting an annulus filler to a rotor disc of a gas turbine engine, the annulus filler bridging the gap between two adjacent blades attached to the rotor disc, the annulus filler having a first part which is connectable to the rotor disc between the positions of said adjacent blades, and a separate second part configured for engagement with the first part, the method comprises the steps of:

installing the first part on the rotor disc in an installation configuration in which the first part is spaced from each said blade by a respective clearance gap (G), and subsequently engaging the second part with the first part to urge the first part from the installation configuration to an operational configuration in which the first part substantially contacts each of said blades.

2. A method of mounting an annulus filler according to claim 1, further comprising the steps of installing the first part on the rotor disc in the installation configuration prior to connection of said blades to said rotor disc.

3. A method of mounting an annulus filler according to claim 2, wherein the step of installing the first part to the disc further includes the step of securing the first part on the rotor disc using a mechanical fastener.

4. A method of mounting an annulus filler according to claim 2, wherein the step of installing the first part to the disc further includes the step of inspecting the mechanical fastener after securing the first part on the rotor disc and prior to the engagement of the second part with the first part.

5. A method of mounting an annulus filler according to claim 1, further comprising the steps of providing said first part with, in transverse cross-section, a pair of spaced-apart and generally radially oriented arms, and wherein on engagement of said second part with said first part urging the radially outer regions of said arms (26) further apart from one another.

6. A method of mounting an annulus filler according to claim 5, further comprising the step of sliding the second part into engagement with said first part in a direction perpendicular to the transverse cross-section.

7. A method of mounting an annulus filler according to claim 6, further comprising the step of engaging the second part removably with axial grooves provided in each arm with each groove receiving a respective edge of said second part.

8. A method mounting an annulus filler according to claim 1, further comprising the step of providing said first part with a pair of seals that contact and substantially seal against respective blades when in said operational configuration.

9. An annulus filler for mounting to a rotor disc of a gas turbine engine and for bridging the gap between two adjacent blades attached to the rotor disc, the annulus filler comprising:

a first part which is connectable to the rotor disc between the positions of said adjacent blades, and a separate second part configured for engagement with the first part, characterised in that said first part has, in transverse cross-section, a pair of spaced-apart and generally radially orientated arms resiliently biased towards an installation configuration in which the first part is spaced from each said blade by a respective clearance gap (G), and an operational configuration in which the first part substantially contacts each of said blades, wherein engagement of the second part with the first part is effective to urge the first part from said installation configuration to said operational configuration and thus towards contact with said blades.

10. An annulus filler according to claim 9, wherein said first and second parts are configured to allow a procedure for mounting the annulus filler to the rotor disc, the procedure comprising a first step in which the first part is connected to the rotor disc without the second part and whilst in said installation configuration, and a subsequent second step in which the second part is engaged with the first part to urge the first part from said installation configuration to said operational configuration and thus towards contact with said blades.

11. An annulus filler according to claim 9, wherein said first part has at least one mounting region for connection to the rotor disc and is configured to allow the or each mounting region to remain substantially visible from a radially outer viewpoint after the first part is mounted to the rotor disc.

12. An annulus filler according to claim 9, wherein the second part is configured for engagement with said first part in a sliding manner, in a substantially axial direction.

13. An annulus filler according to claim 9, wherein each said arm is provided with an axial groove configured to slideably receive a respective edge of said second part.

14. An annulus filler according to claim 9, wherein said first part is provided with a pair of seals to contact and substantially seal against respective blades when in said operational configuration.

15. A stage for a gas turbine engine comprising:

a rotor disc;

a plurality of circumferentially spaced apart blades attached to the rotor disc; and a plurality of annulus fillers bridging the gaps between adjacent blades, each of said annulus fillers having a first part which is connectable to the rotor disc between the positions of said adjacent blades, and a separate second part configured for engagement with the first part wherein the first part is installed on the rotor disc in an installation configuration in which the first part is spaced from each said blade by a respective clearance gap (G), and the second part is subsequently engaged with the first part to urge the first part from the installation configuration to an operational configuration in which the first part substantially contacts each of said blades.

* * * * *